United States Patent [19]

Jacobs

[11] 4,152,578

[45] May 1, 1979

[54] ELECTRIC HEATING ELEMENTS

[75] Inventor: David F. Jacobs, Pittsburgh, Pa.

[73] Assignee: Emerson Electric Co., St. Louis, Mo.

[21] Appl. No.: 838,640

[22] Filed: Oct. 3, 1977

[51] Int. Cl.[2] ..... F24H 1/20; H05B 3/82

[52] U.S. Cl. ..... 219/336; 219/318; 219/322; 219/536; 338/228; 338/229

[58] Field of Search ..... 219/306, 312, 316, 318, 219/322, 335–336, 523, 534, 536; 338/228–230

[56] References Cited

U.S. PATENT DOCUMENTS

| | | | |
|---|---|---|---|
| 3,769,493 | 10/1973 | Zeitlin et al. | 219/335 |
| 3,772,498 | 11/1973 | Temple | 219/316 X |
| 3,860,787 | 1/1975 | Strobach | 219/336 |
| 3,943,328 | 3/1976 | Cunningham | 219/335 |
| 4,001,547 | 1/1977 | Boggs et al. | 219/335 X |

*Primary Examiner*—J. V. Truhe
*Assistant Examiner*—Susan M. Hoffmann
*Attorney, Agent, or Firm*—Michael Williams

[57] ABSTRACT

The novel electric heating element is particularly useful as a water heating element, although its use is not so limited. The element comprises the usual metal-sheathed heater having electrical termination at one end of the sheath. The customary water heating element has a sheath of hair-pin formation, with the ends of the two legs of the sheath connected to structure which serves as a mounting member and an electrical connector. Such structure in the present application is of molded plastic with a metal insert.

16 Claims, 10 Drawing Figures

ELECTRIC HEATING ELEMENTS

BACKGROUND AND SUMMARY

Electric heaters for water tanks have been well known in the art for many years, and generally comprise a metal sheathed heater of hair-pin formation with a metal mounting member connected across the two legs of the sheath. The mounting member was either a plate which was bolted to the tank wall, or a screw plug which was threaded into a fitting on the tank wall. A plastic terminal block was carried by the mounting member and served to electrically insulate the electrical connections from the latter.

The prior art construction required expensive assembly operations and my invention reduces the cost of making a water heater element, and provides other advantages hereinafter described.

DESCRIPTION OF THE DRAWINGS

In the drawings accompanying this specification and forming a part of this application, there are shown, for purpose of illustration, several embodiments which my invention may assume, and in these drawings.

DESCRIPTION OF THE PREFERRED EMBODIMENT

Figure 1:
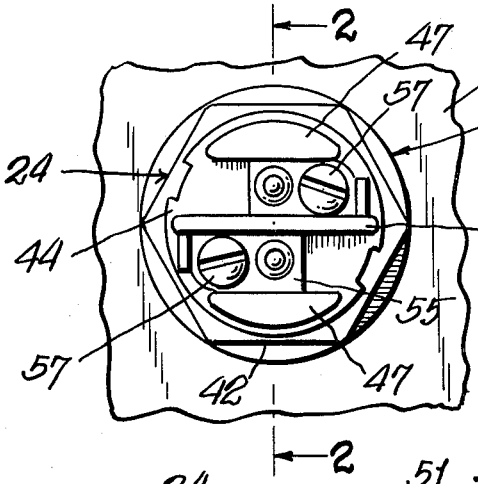
FIG. 1 is an elevational view looking at the head of my improved heating element and showing it attached to a fragmentary part of the wall of a hot water tank.

The embodiment of my invention shown in FIGS. 1 through 5 is a screw-plug type water heater adapted to be threaded into a metal ring 15 which is projection welded to the metal wall 16 of the wall of a water tank, in position to surround the opening 17 in such wall.

The heating element as disclosed is in the form of the well-known hair-pin type and comprises a metal sheath 18 having a bight portion 19 and a pair of legs 20—20 disposed in side-by-side relation. A helically coiled resistance wire 21 is disposed within the sheath 18 and held in centered relation and out of contact with the sheath by compacted refractory material 22, such as compacted magnesium oxide.

Figure 2:
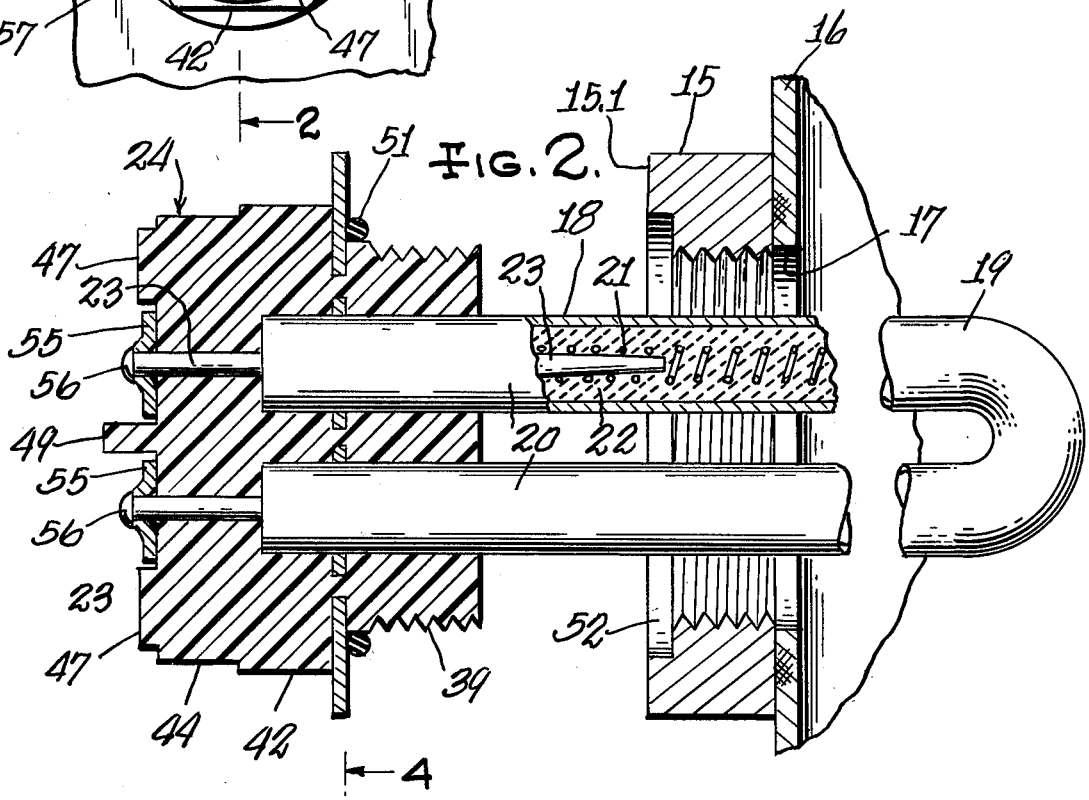
FIG. 2 is an enlarged, fragmentary sectional view corresponding to the line 2—2 of FIG. 1, with the heating element detached from the tank wall.
Figure 3:
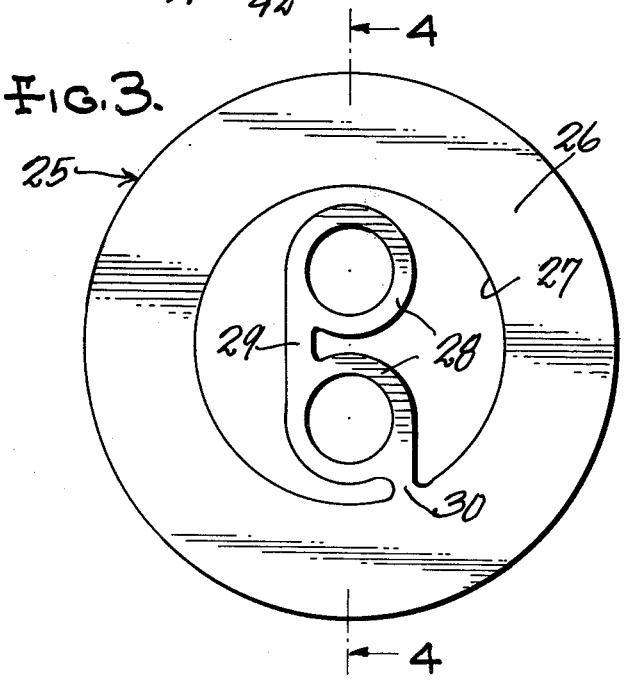
FIG. 3 is a plan view of a metal insert.

Electrically and mechanically secured to each end of the coiled resistance wire is a metal terminal pin 23 and each pin extends outwardly of the end of a respective sheath leg 20, as seen in FIG. 2. In the embodiment disclosed in FIGS. 1 through 5, a mounting member 24 of plastic material is adapted to mount the heating element in position so that its active heating portion is immersed in the liquid contained within the water tank.

Figure 4:
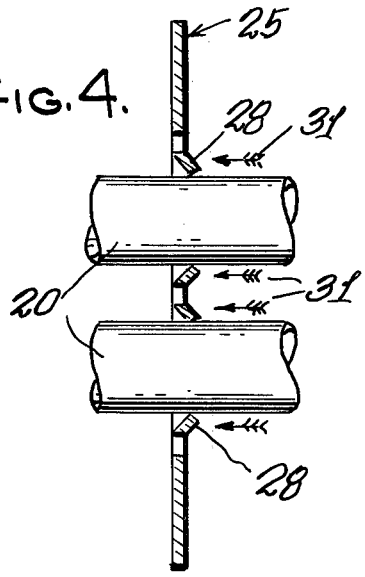
FIG. 4 is a sectional view corresponding to the line 4—4 and showing the insert prior to its assembly with the legs of the heating element.

As a preliminary step, a disc-like insert 25 is secured to the legs 20 of the sheath, and the insert may be formed of any suitable metal, such as cold roll steel plated with a corrosive resistive material such as zinc, or the insert may be formed of copper or brass. The washer-like portion 26 of the insert has a fairly large opening 27. A pair of smaller ring-like portions 28 are connected to each other by an integral intermediate neck 29 and one of the portions 28 is connected to the wall defining the opening 27 by an integral end connector 30. As seen in FIG. 4, the ring-like portions 28 are angularly displaced from the plane of the insert 25 and the legs 20—20 of the heater sheath are inserted through the openings of the portions 28 a predetermined amount. Thereafter, force is applied to the portions 28 in the direction of the arrows 31 against a suitable back-up device (not shown) to force the angularly disposed portions 28 into the plane of the insert. This will force the margins defining the openings in the ring-like portions 28 to dig into the metal of the sheath legs and form an annular seal thereabout.

Figure 5:
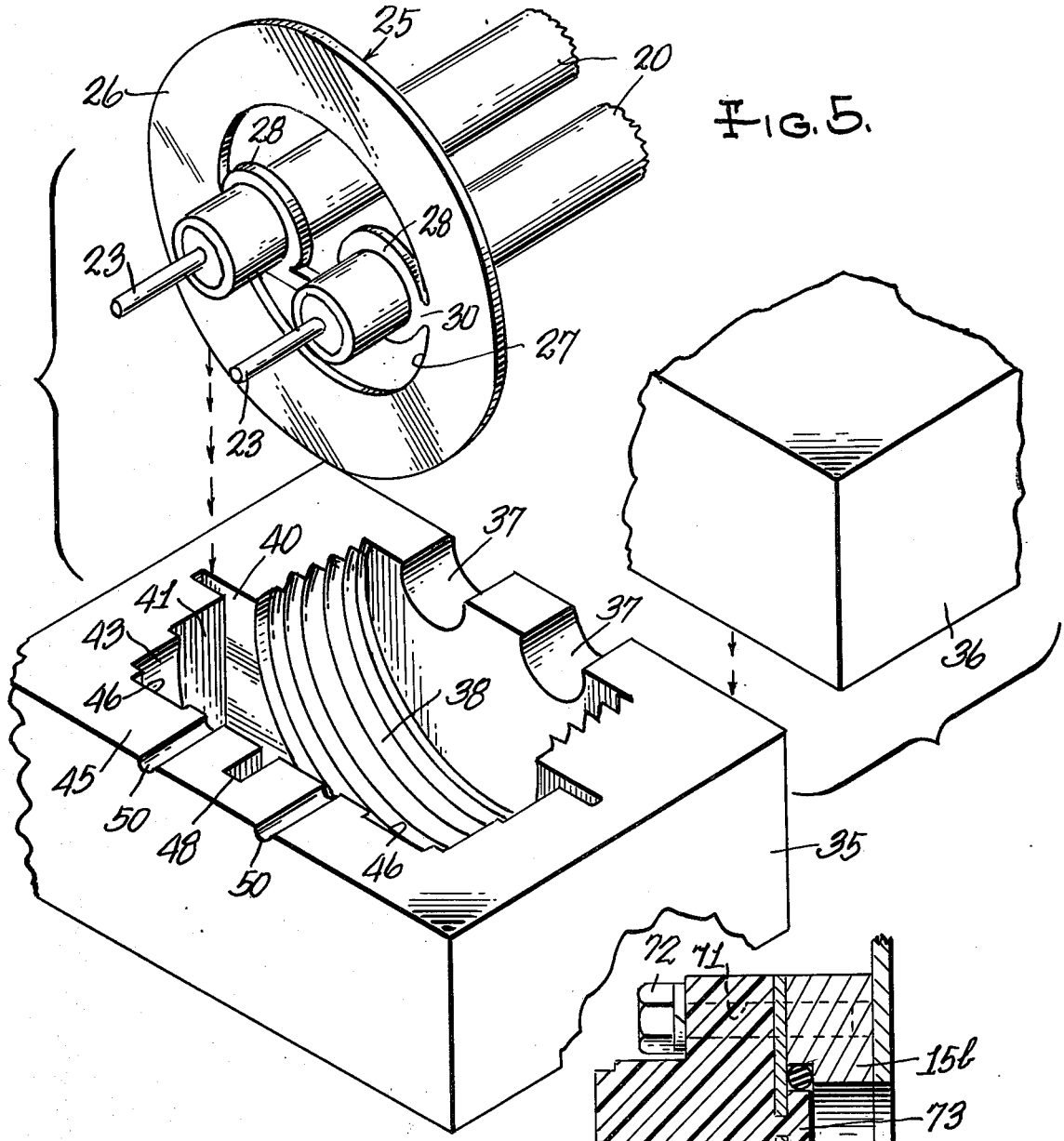
FIG. 5 is a perspective view of parts of a mold which may be used in the formation of my improved heating element, and a fragmentary portion of element parts, FIG. 6 discloses, in section, another embodiment of my invention, showing parts in separated relation.

The heating element, as seen in FIG. 5, is now ready for insertion within a mold for molding the plastic mounting member 24 about the ends of the legs 20—20 of the heating element with the metal insert 25 embedded within the plastic mounting member. The mold is preferably formed in two complementary halves 35 and 36 which are clamped together and about the front portion of the heating element prior to the molding operation. One or both mold halves may have the customary opening through which flowable plastic material may be injected into the mold.

The plastic material is preferably a glass reinforced plastic capable of withstanding high temperatures and offering greater resistance to creep on plastic deformation. Examples of suitable materials for this purpose are Noryl, made by the General Electric Company, or Celcon made by the Celanese Corporation.

FIG. 5 discloses the cavity in the lower half 35 of the mold, the cavity in the upper half 36 being complementary. As shown, a pair of semi-circular openings 37—37 are formed in an end wall of the mold half 35, the openings being dimensioned to closely clamp about the legs 20—20 of the sheath to prevent the injected plastic material from squirting out of the mold. The openings are also closely dimensioned, center-to-center to bring the legs 20—20 into desired spaced relation, since during manufacture of the heating element such legs may not be spaced the desired amount.

The mold half 35 also has a thread-forming cavity 38 to form the exteriorly threaded plug portion 39 of the mounting member 24. Inward of the cavity 38 is a narrow cavity 40 to receive the peripheral portion of the insert 25. Adjacent to the cavity 40 is a cavity 41 of hex shape to provide the hexagonal portion 42 of the mounting member. Adjacent to the cavity 41 is a circular cavity 43 to provide the circular portion 44 of the mounting member. The interior surface of the wall 45 of the mold has recessed portions 46, 46 to form the segment-shaped bosses 47,47 and a central groove 48 to provide the barrier rib 49. Further, the wall 45 has a pair of semi-circular grooves 50—50 to closely fit about the terminal pins 23—23 of the electric heating element so that injected plastic does not squirt out of the mold around the pins. All the cavities, grooves, and recesses just mentioned are also formed in complementary manner in the top mold member 36 so that when the mold halves are closed on each other, a complete overall cavity is formed, with the end of the heating element disposed therein in proper position for the molding operation. The parting line of the mold is considered to be taken along the line 2—2 of FIG. 1.

After the plastic has been injected into the mold, and permitted to cure, the mold is opened and the completed mounting member for the heating element has been formed and is ready for use, although in some cases a certain amount of flash may have to be trimmed off.

The finished molded product is shown in FIGS. 1 and 2 wherein it will be seen that the entire mounting member is an integral unit, with plastic within and through the opening 27 of the insert 25 and integrally joined with plastic forming the plug portion 39 and hex portion 42. The outer peripheral portion of the insert 25 is not covered with plastic and is disposed to engage the face 15.1 of the metal ring 15 when the plug portion 39 is fully threaded into the ring 15, to thereby ground the sheath of the heating element to the tank. Grounding of the sheath is necessary since, if the sheath is completely isolated from electrical connection with the tank, corrosive erosion of the sheath will occur. Adjacent to the insert 25, the plug portion is formed with an annular land for the seathing of a sealing member, such as the rubber O-ring 51 shown in FIG. 2. The O-ring is adapted to fit within an annular groove 52 in the ring 15, and is compressed a proper amount to prevent water leakage when the plug portion 39 has been threaded into the ring to seat the insert 25 in grounding relation against the face 15.1 of the ring.

In addition to its grounding function, the insert 25 provides other desirable results. For example, when the insert is in engagement with the ring 15, it provides for conduction of heat from the heating element to the tank wall to prevent a heat build-up in the plastic support member. The insert 25 also provides a mechanical support for the plastic support member to prevent the normal tendency of plastic to creep away from highly stressed areas.

The insert 25 also helps prevent distortion of the molded part, especially when torque is applied by a wrench on the hex portion 42 to thread the plug portion 39 into the ring 15. Tests have shown that torque in the order of 120 foot pounds may be applied to the hex portion without distortion of the molded part, and this is far in excess of the normally applied torque of 20 foot pounds. The insert 25 also prevents the legs 20—20 of the sheath from pulling out of the molded parts, since the insert is locked to the sheath legs by the ring-like portions 28—28 and provides a broad area in its washer-like portion 26 to resist any pulling of the legs 20—20 from the molded part.

The molded plastic mounting member disclosed above has many advantages over the prior art steel plug, some of which are listed as follows: a separate plastic terminal block is eliminated; the problem of thread corrosion is reduced; a complete unit is formed in one molding operation to thereby reduce the cost of assembling the various parts of a steel plug; a weight reduction of about 20% over the steel plug is possible, and this is important from a shipping standpoint; the entire mounting member is molded around the ends of the sheath legs to thus reduce the possibility of water leakage in the event of burn-through of any portion of the sheath immersed in water. In this connection, attention is called to the annular seal formed by crimping the ring-like portions 28—28 of the insert around the legs 20—20 of the sheath to further reduce the possibility of water leakage because a longer flow path is provided.

After the mounting member 24 has been molded around the ends of the legs 20—20 of the sheath, the heating element may be completed for use in the usual manner. For example, metal terminal strips 55—55 may be applied over the ends of respective terminal pins 20—20 as shown in FIG. 2. Each of these strips is disposed in a spaced defined by facing surfaces of a segment shaped boss 47 and the barrier rib 49 and thus held against rotation about its terminal pin. Each terminal pin 20 is electrically connected to its terminal strip 55 by a heliarc weld 56. Each terminal strip has a threaded opening for the reception of a machine screw 57, the latter being for the purpose of holding a conductor wire to the respective terminal strip so as to provide for the supply of electrical energy to the heating element.

DESCRIPTION OF FIRST OTHER EMBODIMENT

In order to simplify the mold and reduce the cost thereof, especially in low quantity production of my improved electric heater assembly, the mounting member may be molded in two parts which are subsequently joined with each other and the metal insert. In such case, the embodiment disclosed in FIGS. 6 through 9 may be utilized.

Figure 6:
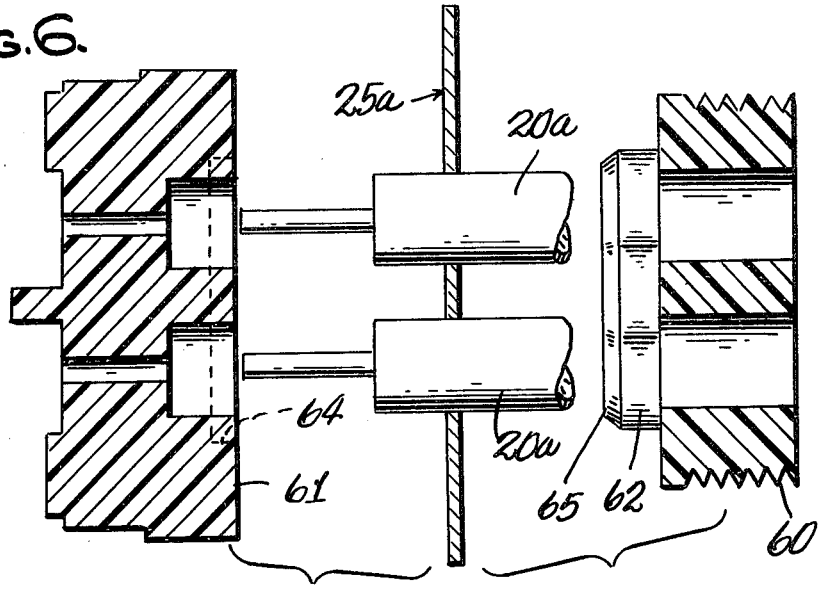
Figure 7:
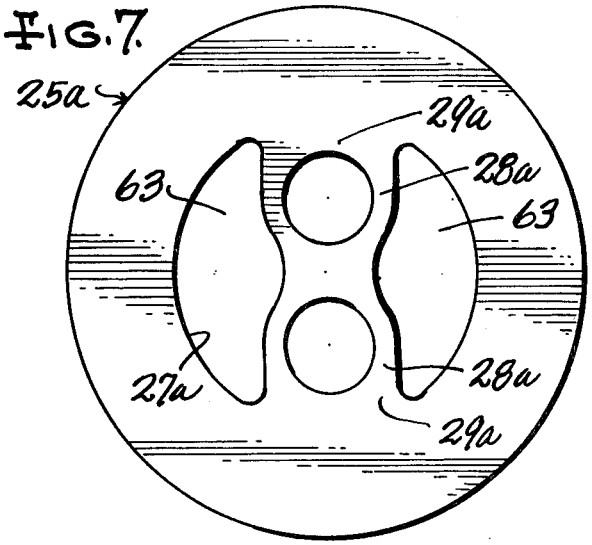
FIG. 7 is a plan view of a metal insert used in the embodiment of FIG. 6, FIGS. 8 and 9 are elevational views showing the faces of two parts used in the embodiment of FIG. 6.

As seen in FIG. 6, the mounting member may be formed from separately molded plug and head portions 60 and 61, the two providing all the features of the molded part heretofore described. In this case, the insert **25*a* is formed in the shape shown in FIG. 7, wherein the ring-like portions 28*a*, 28*a* are integrally connected by necks 29*a*—29*a* to the wall defining the opening 27*a*. As before, the ring-like portions are crimpled around the legs 20*a*—20*a*** of the sheath.

Figure 8:
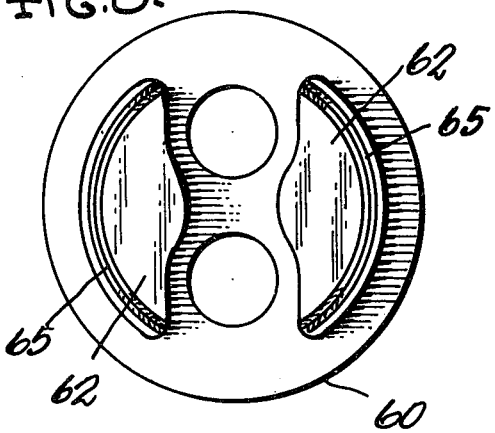
Figure 9:
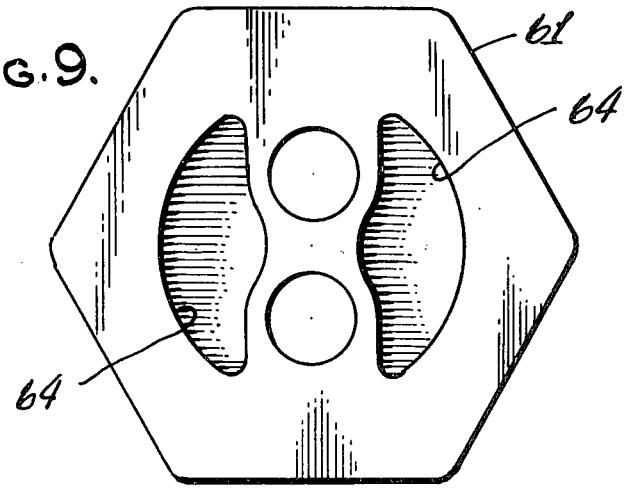

One of the parts 60,61 is molded with a boss and the other part is molded with a recess to receive the boss. In the illustrated embodiment, the plug portion 60 is formed with a pair of bosses 62—62 which extend from a side face thereof. As seen in FIG. 8, the bosses 62 are shaped to the contour of the open spaces 63—63 of the insert **25*a*, to fit closely therethrough. As seen in FIG. 9, two grooves 64—64 are formed in the side face of the head portion 61 and these grooves are shaped to closely receive those parts of respective bosses 62—62 which extend beyond the insert 25*a*. Each of the bosses 62 is formed with a V-shaped ridge 65 for ultra sonic welding of the bosses to the base surface of respective grooves 64—64 to provide a unitary assembly comparable to the embodiment shown in FIGS. 1 through 5**.

To assemble the parts of the embodiment shown in FIGS. 6 through 9, the plug portion 60 is first disposed over the legs of the sheath and may drop as far as the bight portion of the sheath so that it is out of the way. Next, the insert **25*a* is crimped to the sheath legs in proper location thereon. Thereafter, the plug portion 60 is brought to the insert 25*a* and the bosses 62—62 extended through the spaces 63—63 of the insert. Then, the head portion 61 is disposed over the sheath legs 20*a*—20*a*, and extending parts of the bosses 62—62 are seated within the respective grooves 64—64 of the head portion 61. Thereafter, the assembly is placed in an ultrasonic welder and operation of the latter causes the ribs 65—65** and the mating surfaces of the bosses and grooves to fuse to form a unitary assembly of the type shown in FIG. 2.

DESCRIPTION OF FURTHER EMBODIMENT

Figure 10:
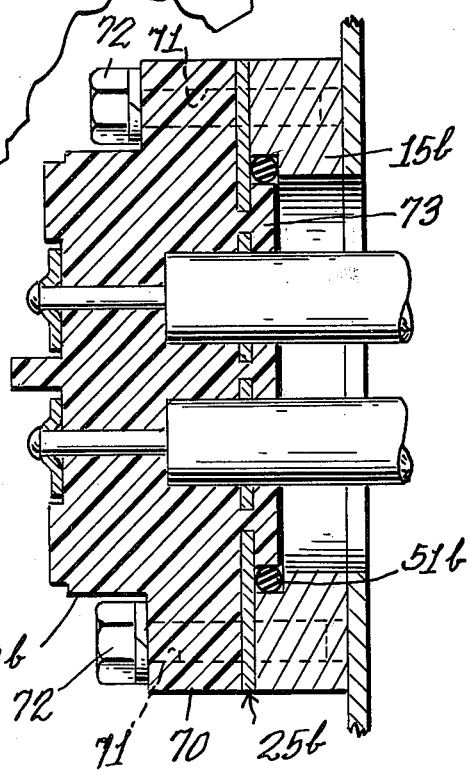
FIG. 10 is a sectional view of another embodiment of my invention.

My invention is adaptable for use as a flange mounting as well as it is for the plug mounting hereinbefore described, and FIG. 10 discloses a flange mount type.

Instead of the hexagonal portion 42 of the embodiment of FIGS. 1 through 5, a flange portion 70 is molded as part of the mounting member, while the circular portion **44*b* remains the same. The flange portion 70 may be circular in plan, but usually it is in the form of a square plate having holes 71** in its four corner portions.

The insert **25*b* has the same internal construction as the insert 25 previously described except that instead of being circular in plan, it is preferably square to match the shape of the flange portion 70, and is provided with four holes to align with the holes 71. The shank of bolts 72 pass through the aligned holes in the flange portion 70 and the insert 25*b* and are threaded in corresponding threaded holes in the metal ring 15*b*. The flange portion 70 has an integral inwardly extending boss 73 to form the annular land for the O-ring 51*b*. It will be appreciated that the mold for producing the molded part shown in FIG. 10 will have a cavity of a suitable configuration to accommodate the flange portion 70, the circular portion 44*b*, boss portion 73, and the insert 25*b***.

I claim:

1. An electric heating element adapted to be mounted on the wall of a metal container with an active heating portion extending through an opening in the wall of the container for heating the contents thereof, said heating element comprising an elongated metal sheath, an electrical resistance heating conductor extending longitudinally within said sheath, a thermally conductive electric insulation material supporting said resistance conductor within said sheath, and an electrical terminal conductor connected to an end of said resistance conductor at a terminal portion of said sheath and extending outwardly of the end of said sheath, the improvement comprising:

a plastic mounting member molded on said sheath terminal portion, said mounting member being adapted for connection to the wall of said container to support said heating element in operative position, and a metal insert having an inner portion within said mounting member and in electrical engagement with said sheath, and an outer portion exposed and adapted to electrically engage a portion of said container wall when said mounting member is connected to said wall.

2. The construction according to claim 1 wherein the inner portion of said metal insert is embedded in the plastic of said mounting member.

3. The construction according to claim 2 wherein said insert is in the form of a washer disposed transversely of said sheath and providing a central opening circumscribed by a flat annular portion, said insert having a ring-like portion disposed within said central opening and joined to the defining margin thereof, said sheath terminal end extending through said ring-like portion and connected thereto, the molded plastic material filling said central opening and extending from opposite sides of said insert, a peripheral part of said flat annular portion being exposed for engagement with said container wall.

4. A metal-sheathed electric heating element of the conventional hair-pin type having a bight portion and legs extending in side-by-side relation with a terminal pin extending outwardly from the end of each leg, said heating element being adapted to extend through an opening in the wall of a metal tank with said bight portion and a major portion of said legs within said tank to heat the contents thereof, the improvement comprising:

a plastic mounting member molded about said terminal pins and adjoining end portions of said legs with the extremity of said pins exposed for electrical connection to a source of electrical energy, said mounting member being adapted for connection to said container wall to support said heating element in operative position, a metal insert having an inner portion within said mounting member and in electrical engagement with at least one of said legs, and an outer portion exposed and adapted to electrically engage a portion of said container wall when said mounting member is connected to said wall.

5. The construction according to claim 4 wherein said molded plastic encapsulates said terminal pins, said adjoining end portions of said legs, and the inner portion of said insert.

6. The construction according to claim 4 wherein said insert is a flat member disposed transversely of said legs and having a large central opening and a pair of actuated portions within said opening, said legs extending through respective apertures and connected to marginal surfaces thereof.

7. The construction according to claim 4 wherein said insert is a flat member disposed transversely of said legs and having a pair of ring-like portions within said opening and integrally connected to each other and one having integral connection with the margin defining said central opening, said legs extending through the openings of respective ring-like portions and having an annular seal connection therewith.

8. The construction according to claim 7 wherein said annular seal connection is made by a crimp connection between said ring-like portions and respective legs.

9. The construction according to claim 4 wherein said plastic mounting member has an integral exterior threaded plug for threading into an internally threaded opening on said tank wall.

10. The construction according to claim 6 wherein said plastic mounting member has an integral exteriorly threaded plug on one side of said flat member, said plug being adapted for threading into an internally threaded opening on said tank wall.

11. The construction according to claim 10 wherein said plastic mounting member has an integral wrench-engaging portion on the opposite side of said flat member.

12. The construction according to claim 10 wherein said plug has an annular land adjacent to said flat member, and a sealing ring on said land and adapted to be compressed between the exposed outer portion of said insert and surface on said tank wall.

13. The construction according to claim 4 wherein said insert is a flat member disposed transversely of said legs, and wherein said plastic mounting member has a transversely disposed peripheral portion formed with openings which match with openings in said flat member to pass the shanks of bolts, the latter being adapted for threading into threaded openings in the tank wall to secure said heating element in operative position.

14. The method of forming a metal-sheathed electric heating element with a mounting member of electrical insulating material, said mounting member being adapted for securement to the metal wall of a tank with electrical continuity between said sheath and said tank wall, said method comprising:

securing a flat metal member to and in electrical contact with said sheath adjacent to and transversely of an end portion thereof, placing said metal member and said sheath end portion within a mold which has a cavity that will permit the molding of plastic material about said sheath end portion and about all but a peripheral portion of said flat metal member, and introducing an electrically insulating plastic material in flowable form into said cavity to fill the same.

15. The method of forming a metal-sheathed electric heating element with a mounting member of electrical insulating material, said mounting member being adapted for securement to the metal wall of a tank with electrical continuity between said sheath and said tank wall, said method comprising:

molding said mounting member of plastic electric insulating material in two parts, each part having an opening to pass an end portion of the sheath of said element and each part having a flat side surface normal to the axis of its opening, one of said parts having a projection extending outwardly from its said flat surface and the other part having a recess extending inwardly from its said flat surface, said projection and said recess being complementarily shaped so that said projection closely fits within said recess, disposing said sheath end portion through the opening in a selected one of said parts and sliding the latter onto said sheath a distance clear of said end portion, securing a flat metal member to and in electrical contact with said sheath end portion, said member having an opening complementary to the projection on said one part to closely pass the same, moving said selected one of said parts so that its flat surface engages one side of said flat metal member, and extending said sheath end portion through the opening of the remaining part so that the flat surface of the latter engages the opposite side of said flat metal member, said projection being of a depth that when said parts are in engagement with opposite sides of said flat metal member, said projection extends through the opening in said flat metal member and seats within the recess of the part formed with the same, and joining the said two parts in the vicinity of the mating projection and recess.

16. The method of claim 15 wherein the said two parts are joined by ultra-sonic welding.

* * * * *

UNITED STATES PATENT OFFICE

CERTIFICATE OF CORRECTION

PATENT NO. : 4,152,578

DATED : May 1, 1979

INVENTOR(S) : David F. Jacobs

It is certified that error appears in the above-identified patent and that said Letters Patent are hereby corrected as shown below:

Column 3, line 27, "seathing" should be ---seating---.
Column 5, line 19, "shank" should be ---shanks---.

Claim 6, lines 4 and 5 thereof, "actuated" should be ---apertured---.

Claim 9, line 2 thereof, "exterior" should be ---exteriorly---.

Signed and Sealed this

*Thirty-first* Day of *July 1979*

[SEAL]

*Attest:*

*Attesting Officer*

LUTRELLE F. PARKER
*Acting Commissioner of Patents and Trademarks*